United States Patent [19]

Watts et al.

[11] 4,386,330

[45] May 31, 1983

[54] HIGH POWER PULSE OPERATED RELAY

[75] Inventors: Roger E. Watts; Leon R. Britton, both of Chicago, Ill.

[73] Assignee: Guardian Electric Manufacturing Company, Chicago, Ill.

[21] Appl. No.: 234,739

[22] Filed: Feb. 17, 1981

[51] Int. Cl.[3] ..... H01H 9/20

[52] U.S. Cl. ..... 335/167; 335/171

[58] Field of Search ..... 335/131, 167, 168, 169, 335/170, 171

[56] References Cited

U.S. PATENT DOCUMENTS 3,005,890 10/1961 White et al. ..... 335/131

3,715,694 2/1973 Kruger ..... 335/131

*Primary Examiner*—George Harris

*Attorney, Agent, or Firm*—Allegretti, Newitt, Witcoff & McAndrews, Ltd.

[57] ABSTRACT

An improved solenoid actuated switch assembly is retained within a housing made from insulating material having three generally parallel recessed passages. The solenoid actuator is retained within the center passage or recess and the parallel side recesses retain heavy duty contacts and blades. A passage between the recesses permits an actuating arm laterally projecting from the solenoid to drive the contact blades in response to movement of the solenoid corepiece. A pivot arm and cam assembly cooperate to retain the corepiece in a first or second position following momentary actuation of the corepiece in response to a signal through the coil.

7 Claims, 9 Drawing Figures

Fig. 5
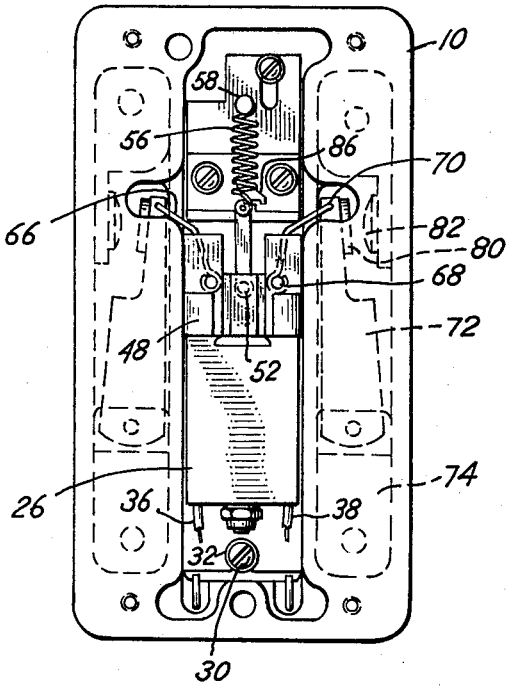
Fig. 6
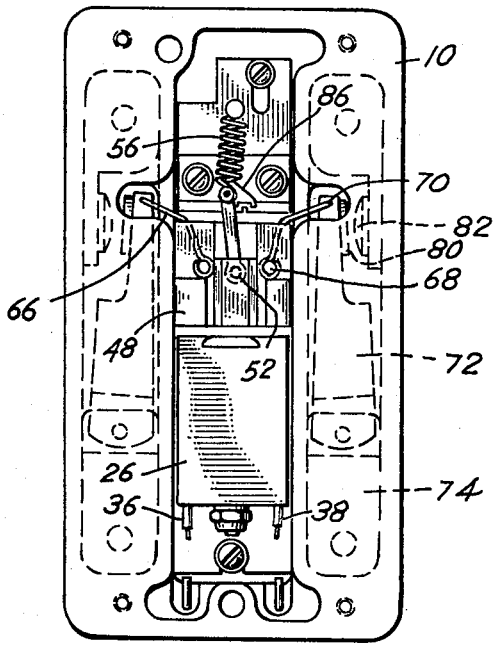
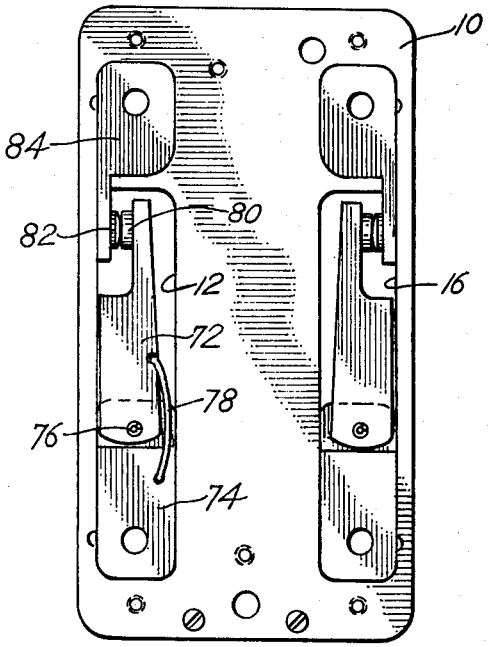
Fig. 7

HIGH POWER PULSE OPERATED RELAY

BACKGROUND OF THE INVENTION

This invention relates to an improved switch and more particularly to a solenoid actuated switch wherein switch contacts are switched to and retained in one of two contact positions subsequent to momentary or pulse actuation of the solenoid.

This invention is generally related to the subject matter of patent application Ser. No. 101,469 filed Dec. 10, 1979 in the name of William W. Wright for a "Bistable Control Switch". That application has now matured into U.S. Pat. No. 4,270,108. That application is incorporated herewith by reference.

Referring to the reference application, there is taught a bistable control switching mechanism especially useful in combination with a coil actuated pivotal armature. The switch mechanism therein disclosed is also especially useful for low power requirements such as encountered in a household current environment.

A device of the nature disclosed would also be useful in higher current and higher power environments. In such environments it is necessary, for example, to open a circuit in response to the momentary impulse of a control signal. Such a switching mechansim would be useful as an overload protector and for various other purposes such as those described in the referenced patent application.

While the structure disclosed in the referenced patent application would be useful and could possibly be used for high power applications, the developement of an improved bistable, pulse operated switch particularly for high power applications was sought. The present invention constitutes such a developement.

SUMMARY OF THE INVENTION

Briefly the present invention comprises a solenoid actuated relay or switch having an axially translatable corepiece positioned within a recess in a housing. An actuator arm projects laterally from the corepiece through a passage into an adjacent recess in the housing where it connects with a movable contact blade to make or break a circuit. The end of the corepiece includes a cooperative cam and cam follower assembly which retains the corepiece and attached movable contacts in one of two staple control positions. Thus, the corepiece is actuated in response to a momentary impulse of current through the coil. This will permit the corepiece to be released from one position and move to the second position to be retained in that position until the next momentary signal is pulsed through the coil.

Thus, it is an object of the present invention to provide an improved two position, bistable solenoid actuated switch or relay.

It is a further object of the present invention to provide a two position switch which includes a solenoid member operative in response to a low power input and effects switching in a high power installation. The switch is maintained in a fixed position following each momentary control signal.

Still another object of the present invention is to provide an inexpensive and reliable bistable switch which may be used for interrupting or reconnecting an electrical circuit, especially a high power circuit.

One further object of the present invention is to provide an improved bistable control switch having enhanced safety characteristics.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 5 is a top view similar to the preceeding figures wherein the solenoid has again been momentarily actuated causing release thereof from the retained position;

FIG. 6 is a top plan view of the next succeeding step in the actuation of the switch of the present invention wherein the solenoid current has been turned off thereby permitting the corepiece to ride upward toward the stable position represented by FIG. 1;

FIG. 7 is a bottom plan view showing the arrangement of the recesses in the housing;

DESCRIPTION OF THE PREFERRED EMBODIMENT

Figure 9:
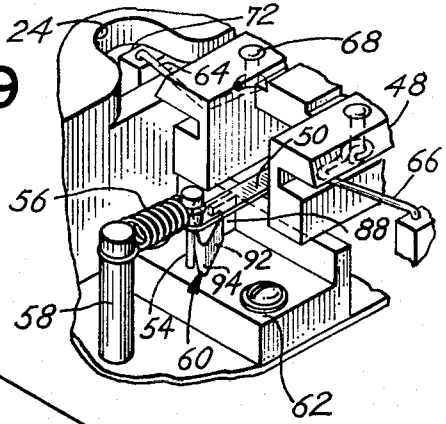
FIG. 9 is a partial perspective view illustrating the contact driving mechanism.
Figure 8:
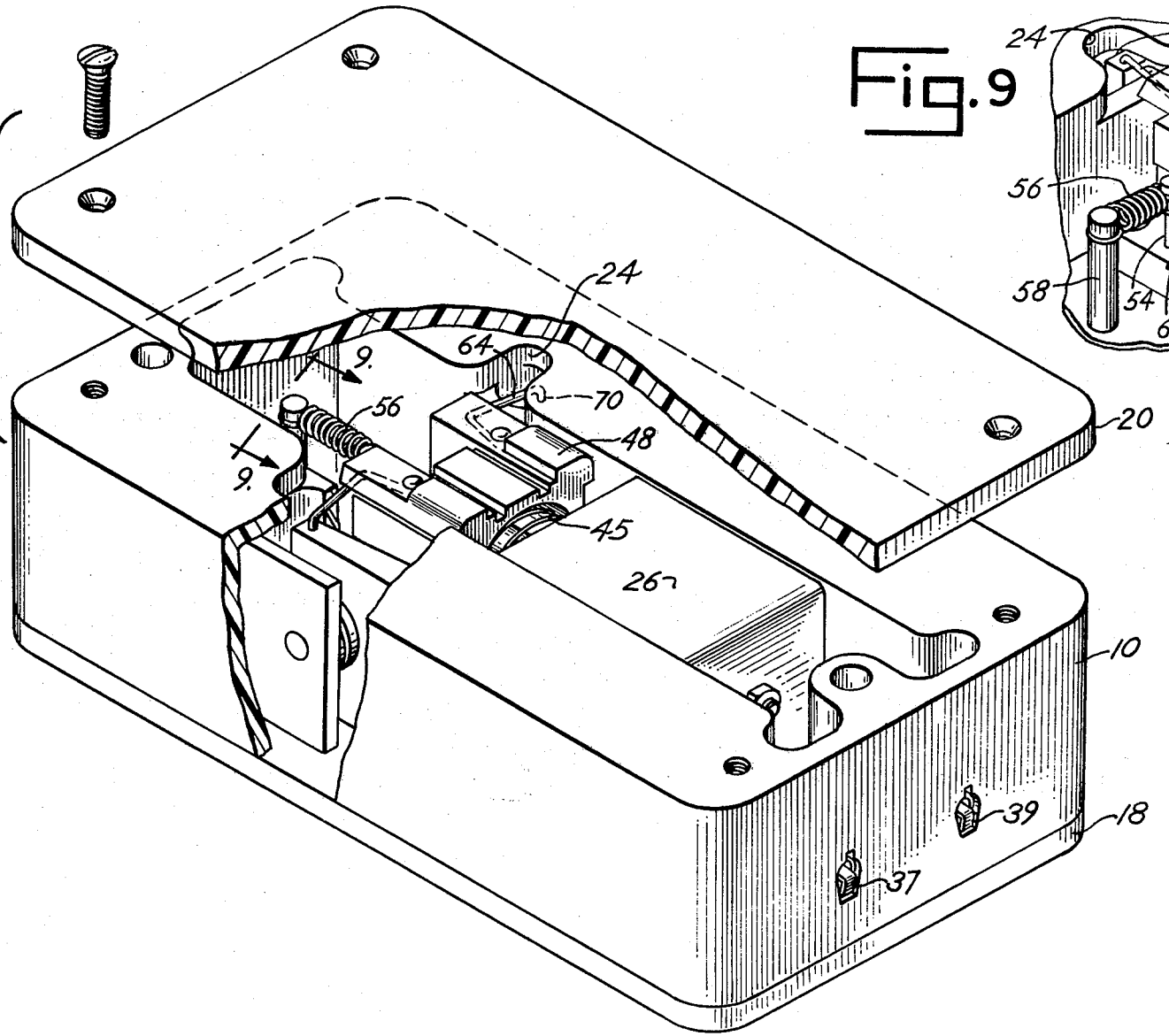
FIG. 8 is an exploded perspective view illustrating the total assembly.

FIGS. 1-6 of the drawing illustrate the components of the present invention as incorporated in a solenoid actuated switch during the sequence of operational steps provided by the switch. FIG. 7 illustrates the construction of the contacts in the housing for the switch which construction enhances insulation and safety characteristics of the switch permitting it to be useful with high current loads. FIGS. 8 and 9 are perspective views illustrating the general structure of the switch.

Referring to the figures, the switch assembly of the present invention is retained within a housing 10 that has three generally parallel recesses 12, 14 and 16 arranged longitudinally within the housing 10. Covers 18 and 20 cooperate with the planar sides of the housing 10 to retain the switch components within the housing 10. The center recess 14 receives the solenoid assembly itself. The side recesses 12 and 16 receive switch blade assemblies and are interconnected with the solenoid assembly 14 by means to be described below. The center recess 14 is defined as a counterbore recess in one side of the housing 10 whereas the side recesses 12 and 16 are defined as counterbores from the opposite sides of the block or housing 10. Passages 22 and 24 interconnect the center recess 14 with the side recesses 16 and 12, respectively.

The Solenoid Assembly

As shown in the figures, the solenoid assembly is retained in the middle recess 14. The assembly includes a solenoid frame 26 which is retained on a mounting plate 28. The plate 28 is attached to the bottom of recess 14 by means of fasteners 30. The fasteners 30 fit through slots 32 in the plate 28 so that the solenoid frame 26 and attached components may be adjusted longitudinally within the recess 14.

The solenoid frame 26 encapsulates a solenoid coil 34. Leads 36 and 38 are provided for the coil 34. The leads 36 and 38 are connected to external contacts 37 and 39 in the wall of the housing 10.

The solenoid assembly includes a core or plunger 40 which is translatable within the passage 42 defined by the coil 34. The plunger 40 thus moves in response to passage of a current through coil 34. A rod 44 projects from one end of the plunger 40 and has a retaining nut 46 attached thereto. The nut 46 limits the travel of plunger 40 and is adjustably threaded onto the rod 44. The opposite end of plunger 40 projects from the passage 42 and is rigidly connected to a sliding block 48. A spring 45 is interposed between the frame 26 to bias the plunger longitudinally from the frame 26 as limited by nut 46. The block 48 is sized to slide easily along the sides of the recess 14 and thus center and guide the plunger 40.

The block 40 has a cantilever cam follower arm 50 pivotally attached thereto at a pivot point 52. The pivot point 52 lies generally on the midline axis of the plunger 40. The arm 50 pivots about the point 52 in the plane of the housing 10 as shown in FIGS. 1–6. The arm 50 is a rigid arm which terminates at its extreme end with a downwardly extending cam follower pin 52. Also attached at the outer end of the arm 50 is a spring 56 which connects at its opposite end to a post 58 affixed to the mounting plate 28. The spring 56 acts on the arm 50 to rotate or pull the arm 50 about the pivot point 52 so that the arm 50 will align itself on the axis of plunger 40.

The pin 54 cooperates with a cam 60 that is formed in a cam plate or cam mounting plate 62. The plate 62 is affixed to the solenoid mounting plate 28 and is adjustable with respect thereto in a direction along the axis of plunger 40. The cam 60 has a shape of the type disclosed in U.S. Pat. No. 4,270,108, Ser. No. 101,469 referenced herein before. The pin 54 cooperates with the cam 60 in a manner similar to that described in said patent. This description of operation with respect to a solenoid device is set forth in greater detail below.

Attached on opposite sides of the pivot point 52 and extending laterally from the sliding block 48 are actuating arms or wires 64 and 66. The arm or wire 64 is pivotally attached to block 48 at pivot point 68. The arm 64 is generally L-shaped and connects at its opposite end into a pivot opening 70 associated with a movable contact blade 72. Movement of the block 48 in response to actuation of the plunger 40 causes the arm 64 to translate the blade 72 in the plane of the housing 10. The arm 66 is of similar construction to that described for the arm 64.

The Blade and Contact Assembly

As shown in FIG. 7, movable blade 72 is attached to a connector bar 74 at a pivot point 76. The blade 72 thus pivots about the point 76. Both the blade 72 and the bar 74 are preferably made from a conductive copper material. The blade 72 and bar 74 are electrically connected by means of a flexible wire conductor 78. A pivotal contact 80 is attached to the blade 72. A stationary contact 82 is affixed to a stationary contact bar or buss bar 84. Pivotal movement of the blade 72 causes the contacts 80 and 82 to make or break a circuit. The bars 74 and 84 thus contact with high power lead wires. The blade and contact assembly associated with the recess 16 is of similar construction though a mirror image of that just described with respect to the recess 12.

Note that as shown in FIG. 9, the actuating wire or arm 64 extends through the passage 24 from the recess 14 into the recess 12 and more particularly from the sliding block 48 to the movable blade 72. In this manner the separate components of the assembly are insulated from one another to prevent any arcing or short circuiting.

Cam Form and Solenoid Operation

Figure 1:
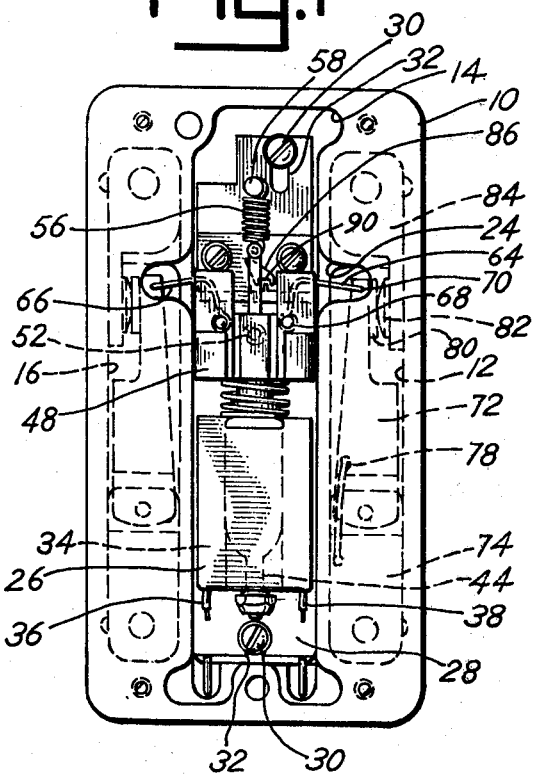
FIG. 1 is a top plan view of the improved solenoid actuated, bistable switch assembly of the present invention wherein the cover for the assembly is removed to expose the solenoid, blades and contacts and wherein the switch is in a contact closed position.

Referring first to FIG. 1, the assembly is in a position where there is no current passing through the solenoid coil 34. Thus, the compression spring 45 which is positioned between the frame 26 and block 48 projects the block 48 to its full extended position as limited by the retaining nut 46. In this position the arms 64 and 66 are extended to their maximum lateral extent thereby closing the contacts 80 and 82. A spring 56 draws the arm 50 along the axis of plunger 40 and retains it in a straight line configuration.

Figure 2:
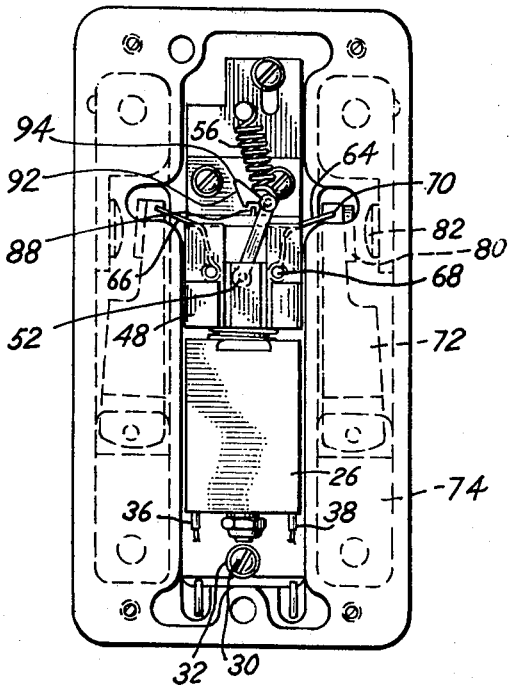
FIG. 2 is a top plan view similar to FIG. 1 and illustrating the next sequential step in the operation of the switch of the invention wherein the solenoid has been actuated to cause movement thereof to effect separation of the contacts.

FIG. 2 represents the next step in the operation of the solenoid assembly. That is, the solenoid coil 34 is actuated by passage of current therethrough. This causes the plunger 40 to be drawn against the force of the compression spring 45. Simultaneously the block 48 is withdrawn in the same direction causing the arms 64 and 66 to pivot their associated blades 72 and break the circuit through the contacts 80 and 82 by separating those contacts. At the same time the pin 54 of arm 50 engages against the inclined cam surface 86 causing the arm 50 to pivot in a clockwise direction and follow the surface 86.

Figure 3:
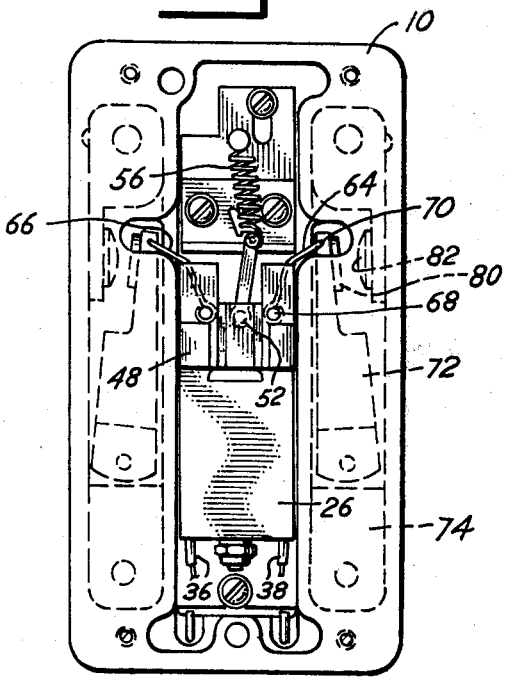
FIG. 3 is a top plan view similar to FIGS. 1 and 2 wherein the solenoid has been actuated and traveled to one extreme position to separate the contacts and break the circuit.

Subsequently, as shown in FIG. 3, the solenoid plunger 40 is withdrawn to its maximum actuated downward position. This causes the pin 54 to follow the surface 86 to its maximum extent where it is released from that surface. Release is effected by action of the spring 56 causing the arm 50 to pivot in a clockwise direction. The pin 54 then engages against the upward wall or stop 88 where the pin 54 is retained so long as the coil 34 receives current.

Figure 4:
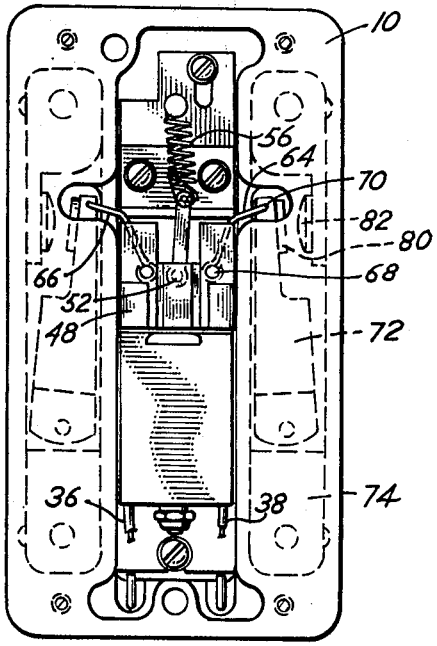
FIG. 4 is a top plan view similar to the preceeding figures wherein current to the solenoid coil has been terminated and a spring actuation of the solenoid has caused the solenoid to ride into a fixed stable position where it is retained by a cam and follower mechanism.

Subsequently, as shown in FIG. 4, the solenoid coil 34 is deactivated. This permits the plunger 40 to rise slightly due to the action of the compression spring. The pin 54 then rides into slot 90 in the cam 60. Further translation of the plunger 40 is prevented by the coaction of pin 54 and slot 90. Note that the contacts 80 and 82 remain in an open position even though current through the coil 34 has been terminated. Note that the slot or notch 90 is on the clockwise side of the center line axis of the plunger 40.

FIG. 5 represents the next sequential step in the operation of the device. In FIG. 4 the coil 34 is again actuated causing the pin 54 to follow along the left hand side of the notch 90 and where it is released from that notch 90 as the pin is retracted in the downward direction due to actuation of the coil. Release from the notch 90 is effected by means of the force associated with the spring 56. The component of force is transverse to the direction of the axis of the plunger 40. The current through the coil 34 thus aligns the arm 50 in a direction straight along the axis of plunger 40.

Release of current through the coil 34 will then permit the spring 45 to drive the block 48 and cause translation and movement of the various component parts as shown in FIG. 6. Thus, the plunger 40 is driven by the compression spring 45 so that the pin 54 rides against the back side surface 92 of the cam 60 and over the end 94 of the cam 60. Again, the spring 56 causes the pin 54 to remain against the cam surface and to be drawn toward the center line axis of plunger 40. The final position of the assembly is represented again by FIG. 1. The cycle can then be repeated by two complete momentary actuation signals through the solenoid coil 34.

Thus, it can be seen that the present invention relates to an improved bistable switch assembly which utilizes a solenoid in combination with a special cam and follower assembly so that the momentary actuation of the solenoid will permit maintenance of the switch in an open or closed circuit position. The switch is especially useful for high powered or high current applications. While in the foregoing there has been set forth a preferred embodiment of the invention, it is to be understood that the invention is limited only by the following claims and their equivalents.

What is claimed is:

1. An improved solenoid actuated switch assembly comprising, in combination:

a housing having at least two separate recesses separated by an insulating wall;

a solenoid in one recess having a core piece actuator projecting axially and movable in response to current in the solenoid coil in a first axial direction;

biasing means for biasing the coil piece actuator in the opposite axial direction;

a laterally pliable cam follower projecting axially from the end of the corepiece actuator;

a cam affixed to the housing and cooperative with the follower;

a contact blade actuator projecting laterally from the corepiece actuator extending from the one recess into the next adjacent recess; and a movable contact blade in the other recess connected to the contact blade actuator and movable to make and break a circuit.

2. The switch assembly of claim 1 wherein the cam follower comprises a cantilever arm pivotally attached to the corepiece actuator and a spring member applying a component of force on the arm perpendicualr to the direction of the corepiece actuator axis whenever the arm forms an angle with the axis and providing means for maintaining the follower against the active surface of the cam.

3. The switch assembly of claim 1 wherein said corepiece actuator includes a sliding block affixed to the end of the corepiece actuator, said block comprising a pivot mount for the follower and the contact blade actuator, and also comprising a stop for the biasing means.

4. The switch assembly of claim 1 wherein said housing includes three separate recesses, said recesses comprising generally parallel recesses aligned axially with the corepiece actuator axis, the center recess adapted to receive the corepiece actuator, and each of said side recesses adapted to receive contacts and contact blades; said assembly including a contact blade actuator projecting laterally into each side recess from the corepiece actuator.

5. The assembly of claim 1 wherein said housing is formed from a molded insulating block having parallel recesses defined in opposite sides of the block, said recesses connected by a passage through a wall between the recesses.

6. The assembly of claim 5 including cover plates for the opposite sides of the block to retain the components within the recesses and insulate the components.

7. In a bistable position switch of the type including a coil, a corepiece movable with respect to the coil and responsive to current passing through the coil, corepiece holding and release mechanism for effectively maintaining the corepiece in a first coil actuated position upon termination of current through the coil and in a second release position upon subsequent actuation of the corepiece by the coil followed by release thereof, said mechanism of the type including:

(a) a cantilever member projecting from the corepiece, said member being flexible in a plane generally transverse to the direction of corepiece movement;

(b) a cam guide member fixed with respect to the cantilever member, said cam guide member being cooperative with the cantilever member and including a (i) first track for guiding the cantilever member to a notch holding position, and (ii) a second track for guiding the cantilever member from the notch holding position to a release position; the improvement comprising, in combination:

a rigid cantilever member pivotally attached at one end to the corepiece at a point on the axis of translation of the corepiece and biasing means affixed to the arm to bias the arm toward a parallel position with the axis, and arm including a follower pin for cooperation with the cam guide member.

* * * * *